US008582723B2

(12) United States Patent
Behling et al.

(10) Patent No.: US 8,582,723 B2
(45) Date of Patent: Nov. 12, 2013

(54) ROTATABLE ANODE AND X-RAY TUBE COMPRISING A LIQUID HEAT LINK

(75) Inventors: Rolf Karl Otto Behling, Norderstedt (DE); Michael Lübcke, Hamburg (DE); Christoph Bathe, Hamburg (DE); Wolfgang Chrost, Hamburg (DE)

(73) Assignee: Koninklijke Philips N.V., Eindhoven (NL)

( * ) Notice: Subject to any disclaimer, the term of this patent is extended or adjusted under 35 U.S.C. 154(b) by 337 days.

(21) Appl. No.: 13/131,070

(22) PCT Filed: Nov. 19, 2009

(86) PCT No.: PCT/IB2009/055172

§ 371 (c)(1),
(2), (4) Date: Jun. 6, 2011

(87) PCT Pub. No.: WO2010/061323

PCT Pub. Date: Jun. 3, 2010

(65) Prior Publication Data

US 2011/0228905 A1 Sep. 22, 2011

(30) Foreign Application Priority Data

Nov. 26, 2008 (EP) ..... 08169942

(51) Int. Cl.
*H01J 35/00* (2006.01)

(52) U.S. Cl.
USPC ..... 378/132; 378/144

(58) Field of Classification Search
USPC ..... 378/119, 121, 125, 132, 143, 144
See application file for complete search history.

(56) References Cited

U.S. PATENT DOCUMENTS

| | | | |
|---|---|---|---|
| 6,807,348 | B2 | 10/2004 | Lu et al. |
| 2006/0193439 | A1 | 8/2006 | Anno et al. |

FOREIGN PATENT DOCUMENTS

| | | | |
|---|---|---|---|
| JP | 58123645 | | 7/1983 |
| JP | 05003008 | A | 1/1993 |
| JP | 06045245 | A | 2/1994 |
| JP | 2005123085 | A1 | 5/2005 |
| WO | 2009022292 | A2 | 2/2009 |

*Primary Examiner* — Courtney Thomas

(57) ABSTRACT

In a rotatable anode (4) of an X-ray tube, a heat transfer between the rotating disc of the anode (4*a*) and the second bearing element (11) is achieved by providing a contact material (14) within a gap (16*a, b*) between the anode disc (4*a*) and the second bearing element (11). Contact elements (15) protrude from the second bearing element (11) into the contact material (14), thus allowing a heat transfer from anode disc (4*a*) to second bearing element (11) via contact material (14) and contact element (15).

11 Claims, 4 Drawing Sheets

ROTATABLE ANODE AND X-RAY TUBE COMPRISING A LIQUID HEAT LINK

TECHNICAL FIELD OF THE INVENTION

The present invention relates to X-ray tube technology in general.

More particularly, the present invention relates to a rotatable anode for generating X-rays, to an X-ray tube comprising a rotatable anode as well as an X-ray system comprising an X-ray tube.

In particular, the present invention relates to the rotatable anode comprising a liquid heat link between the anode and a bearing element for rotating anode disc in an X-ray tube.

BACKGROUND OF THE INVENTION

X-ray tubes are employed for example in X-ray systems for medical applications. An X-ray tube is used to generate electromagnetic radiation which may be used e.g. for medical imaging applications.

Regularly, electrons are accelerated between a cathode and an anode within an evacuated housing for producing X-rays. The electrons impinge on a part of the anode called the focal spot, thus creating electromagnetic radiation.

X-ray generation may be considered to be very inefficient, as a major part of the applied energy is converted to heat. The dissipation of heat, in particular at the focal spot, may be considered to be one of the central limitations of X-ray tubes.

By employing a rotating anode, the area of impingement of the electrons, the focal spot, may be considered to be a non-static area on the surface of the rotating anode disc.

Thus, by rotating the anode, the heat load acting on the focal spot and thus the anode may be spread over a larger area, increasing the power rating of the X-ray tube substantially.

An according rotating anode X-ray tube may generate X-radiation in a diagnostic system. The anode of the X-ray tube may heat up upon operation and may cool down afterwards. This thermal cycling may cause thermo-mechanical distortions of tube components so that the tubes may have to be designed to function reliably under all application conditions.

Thus, high-performance X-ray tubes may use hydrodynamic bearings to support the rotating anode while dissipating heat from the anode by direct conduction cooling towards an external cooling fluid. Due to the evacuated tube housing, other means for heat removal, e.g. by convection, may be difficult to achieve.

However, the thermal conductivity of an anode may be limited by a breathing "vacuum" gap between the anode disc and the bearing. An according gap may compensate expansion and/or reduction in size of the individual anode parts, in particular the disc-shaped anode element, due to the heating-up during operation and the cooling-down after operation of the X-ray system.

Furthermore, the "breathing" vacuum gaps may be required to align the anode and the bearing shaft to compensate for thermal stresses.

SUMMARY OF THE INVENTION

Thus, there may be a need to provide enhanced cooling, at least of individual parts of a rotatable anode.

According to the independent claims, a rotatable anode for generating X-rays, an X-ray tube comprising a rotatable anode according to the present invention as well as an X-ray system comprising an X-ray tube according to the present invention are provided.

According to an exemplary embodiment of the present invention, a rotatable anode for generating X-rays is provided, comprising a bearing, the bearing comprising a first bearing element and a second bearing element, wherein the second bearing element is rotatable about the first bearing element.

Furthermore, the rotatable anode comprises an anode element arranged at the second bearing element, an opening or gap, arranged between the second bearing element and the anode element, wherein the opening is at least partly filled with a contact material and at least one contact element having a first end and a second end, wherein the first end is arranged at the second bearing element and wherein the second end is arranged to extend into the contact material.

According to a further exemplary embodiment of the present invention, an X-ray tube is provided, comprising an X-ray source with a cathode element and a rotatable anode element according to the present invention, wherein the cathode element and the rotatable anode are operatively coupled for the generation of X-rays.

According to a further exemplary embodiment of the present invention, an X-ray system is provided, comprising an X-ray tube according to the present invention and an X-ray detector, wherein an object is arrangeable between the X-ray tube and the X-ray detector and wherein the X-ray tube and the X-ray detector are operatively coupled such that an X-ray image is obtainable of the object.

A rotatable anode may comprise a hydrodynamic bearing to allow a rotation of a disc-shaped anode element, thus continuously varying the focal spot while generating X-rays. An according bearing may comprise a first bearing part, which may be substantially stationary and which may be used to affix the rotating anode within the evacuated space of the X-ray tube and a second bearing element.

The second bearing element may be arranged at the first bearing element so as to be movable in relation to the first bearing element, in particular rotating about the first bearing element.

A disc-shaped anode element comprising the focal spot may be attached to the rotating bearing element, i.e. the second bearing element. The anode disc may for example be attached to the second bearing element by a non-positive connection, e.g. may be clamped to the second bearing element by employing a nut, which provides a compression force to affix the anode disc to a protruding part of the second bearing element.

As the anode disc may heat up while in operation and may cool down afterwards, a gap or opening between the anode disc and the second bearing element may be provided to allow for an increase or reduction regarding the dimensions of the anode disc, e.g. due to thermal expansion when being heated up during operation.

Thus, thermal stresses which affect the performance of the anode disc may be avoided by providing an according gap, i.e. by arranging the bearing and the anode disc in a radially spaced apart arrangement.

However, a gap comprising essentially no material, as may be the case in an evacuated X-ray tube, may be considered to provide poor thermal conduction for cooling of the anode disc.

Thus, a layer of contact material, e.g. contact metal like for example an indium tin alloy, may be provided within the gap between the anode disc and rotatable bearing element, in particular the second bearing element.

The contact material/metal may be considered to be liquid when the temperature of the anode disc exceeds the melting point of the material/metal (e.g. 110° C. for InSn)

Below the melting temperature, the contact metal may be considered to be frozen while staying relatively soft, like e.g. tin solder.

The contact metal may be contained within the gap by seals. For example, a fixed seal may be provided at one end, whereas a flexible capillary force seal, e.g. a spring steel ring, may be provided at a further end of the gap. Gaps between seal, e.g. a steel ring and a bearing element may be required to be of sub-micrometer size to avoid leakage of the contact material.

During anode rotation, the (liquid) contact material is forced due to rotational forces to the outermost parts of the gap, thus may substantially align with the inner surface of the anode disc, constituting a part of the gap.

To provide a preferred thermal conduction even during rotation, at least one contact element may protrude from the rotating bearing element in the direction of the anode disc and being at least partly submerged within the contact material.

E.g. sharp edged fins may reach out radially from the rotating bearing element into the liquid layer of the contact material to provide a thermal contact for heat dissipation from the anode to the rotating bearing element. There may be some vacuum space left adjacent to the rotating bearing element.

After the operation of the X-ray tube, upon cooling down of the anode, the contact material may be considered to substantially freeze or solidify.

The anode diameter may also shrink due to a reduced temperature of the anode disc upon further cooling. The contact material may be considered to be relatively soft even in the cooled down state. The sharp fins cut into it upon cooling. Therefore, pressure forces caused by the shrinking of the anode disc, thus the pressing of the contact material onto the contact elements, may be considered to be substantially neglectable.

The contact of the at least one contact element, e.g. the sharp edged fins and the contact material may be considered to be a shear contact. Large radial pressure inwards on the bearing member and/or the contact element, imposed during the cooling process, may be avoided.

Furthermore, a thermal contact may even be provided in a frozen state of the contact material as it may still surround the contact element, e.g. being pressed or forced against and/or between the sharp edged fins.

The thermal/heat transfer may be considered to be substantially perpendicular to the rotational axis of the rotating anode/anode disc and in particular in the direction of the radial extension of the anode disc.

In the following, further embodiments of the present invention are described referring in particular to a rotatable anode for generating X-rays. However, these explanations also apply to the X-ray tube and the X-ray system.

It is noted that arbitrary variations and interchanges of single or multiple features between the claimed entities are conceivable and within the scope and disclosure of the present patent application.

According to a further exemplary embodiment of the present invention, the anode element may be attached to the second bearing element such that a dimensional variation due to thermal expansion reduction is absorbable.

Thus, thermal stresses, which may occur due to the shrinking of material and/or the expansion of material when heating up or cooling down individual elements of the rotatable anode may be avoided.

In particular, the anode element may be attached to the second bearing element such that in the direction of expansion/reduction in size, in radial direction, no direct contact between the anode elements and the second bearing element may be provided.

According to a further exemplary embodiment of the present invention, thermal energy may be transmissible between at least two elements selected from the group consisting of anode element, contact material, contact element and second bearing element.

An according feature may provide a substantially uniform heating up or cooling down of the rotatable anode and the individual parts respectively.

Furthermore, thermal energy may even be transmissible between the second bearing element and the first bearing element, e.g. via a hydrodynamic bearing, to dissipate thermal energy via the attachment of the bearing element, in particular the first bearing element.

According to a further exemplary embodiment of the present invention, the contact material may be one material selected from the group consisting of thermally conductive material, contact metal, liquid metal like molten Bismuth and Indium Tin alloy.

The use of an according contact material may provide a dissipation of thermal energy while reducing the occurrence of mechanical stresses, in particular between the anode element, the contact material, the contact element and/or the second bearing element, between a heated state and a cooled-down state.

According to a further exemplary embodiment of the present invention, the bearing may comprise a rotational axis and the at least one contact element may be arranged radially extending from the rotational axis at the second bearing element.

With the contact elements extending radially from the rotational axis of the second bearing element, e.g. perpendicular to the rotational axis, the direction of extension of the contact element may be considered to be substantially identical to the direction of movement of the contact material within the gap while an operation, i.e. while rotating.

Thus, a preferred contact between the contact element and the contact material may be achieved.

According to a further exemplary embodiment of the present invention, the second end of the contact element is tapered for piercing the contact material.

An according feature may allow to penetrate the contact material in a cooled down state so as to avoid mechanical stresses.

According to a further exemplary embodiment of the present invention the second end of the contact element is adapted as a sharp edged fin.

An according contact element may provide a preferred shape for penetrating, thus achieving contact, with the contact material for preferred heat transfer, e.g. by maximizing the area of contact between the contact element and the contact material.

According to a further exemplary embodiment of the present invention, the contact element and the second bearing element may be integrally formed.

An according feature may allow for an economical manufacture while maximizing the transfer capability of thermal energy between the contact element and the second bearing element.

According to a further exemplary embodiment of the present invention, the contact material may be sealed within the opening or gap by at least one element selected from the group consisting of a seal, a fixed seal, a flexible seal, a flexible capillary force seal, a washer, a graphite washer, a spring ring, a spring metal ring and a spring steel ring.

According seals may allow for a tight sealing of the gap, in particular of the contact material within the gap, while still providing the necessary flexibility related to an expansion or contraction of the anode disc in different thermal situations, e.g. an expanded gap during operation, i.e. a higher temperature situation, and a reduced gap volume in the cooled-down state.

These and other aspects of the present invention will become apparent from and elucidated with reference to the embodiments described hereinafter.

Exemplary embodiments of the present invention will be described below with reference to the following drawings.

The illustration in the drawings is schematic. In different drawings, similar or identical elements are provided with the similar or identical reference numerals.

The figures are not drawn to scale, however may depict qualitative proportions.

DETAILED DESCRIPTION OF EMBODIMENTS

Figure 1:
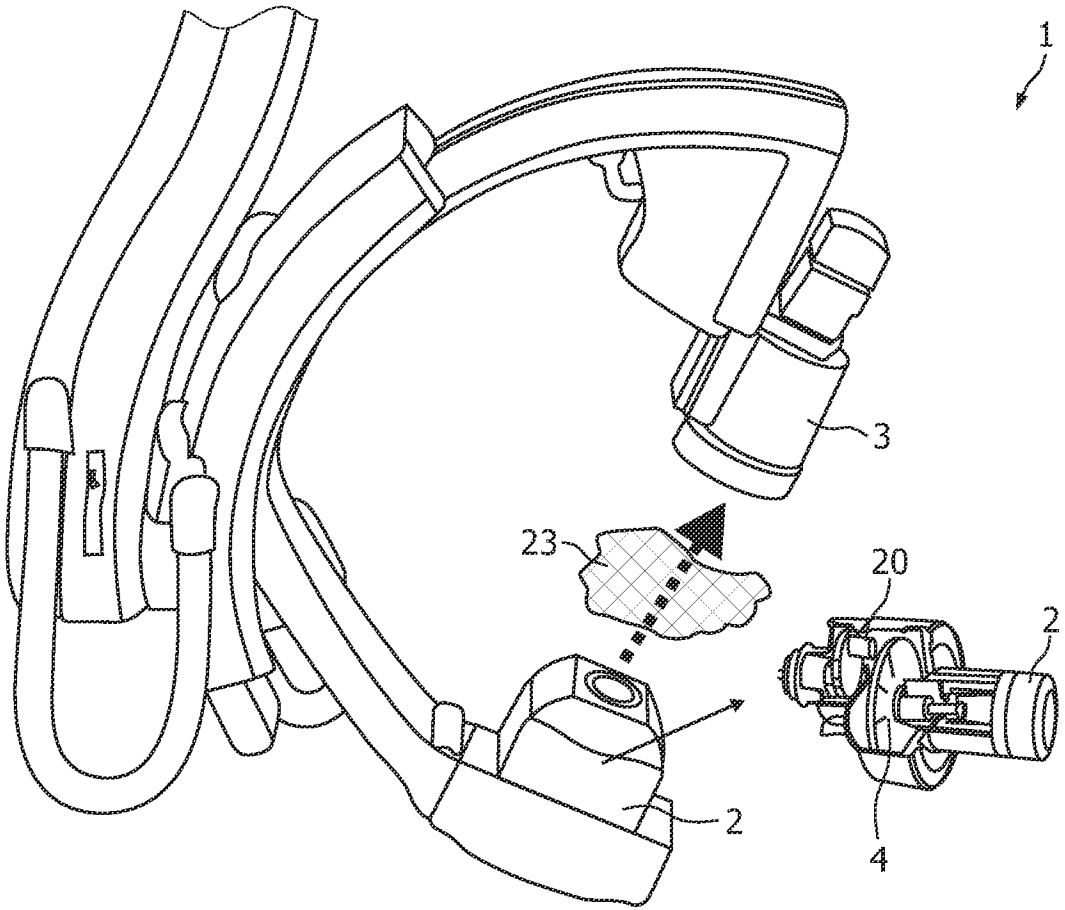
FIG. 1 shows an X-ray system comprising an X-ray tube according to an exemplary embodiment of the present invention.

Now referring to FIG. 1, an X-ray system comprising an X-ray tube according to the present invention is depicted.

X-ray system 1 comprises an X-ray generating unit (an X-ray tube) 2 and an X-ray detector 3. X-ray tube 2 and X-ray detector 3 are aligned and operationally coupled to allow for the acquisition of an X-ray image of an object situated in between the X-ray tube 2 and the X-ray detector 3.

The X-ray system 1 according to FIG. 1 is ceiling mountable and comprises multiple degrees of movement freedom to allow for a flexible alignment and positioning of the X-ray system, i.e. in particular a C-arc, for image acquisition of an object 23, e.g. during an operation.

The X-ray tube 2 comprises a rotatable anode 4 and a cathode element 20 for generation of X-radiation.

Figure 2:
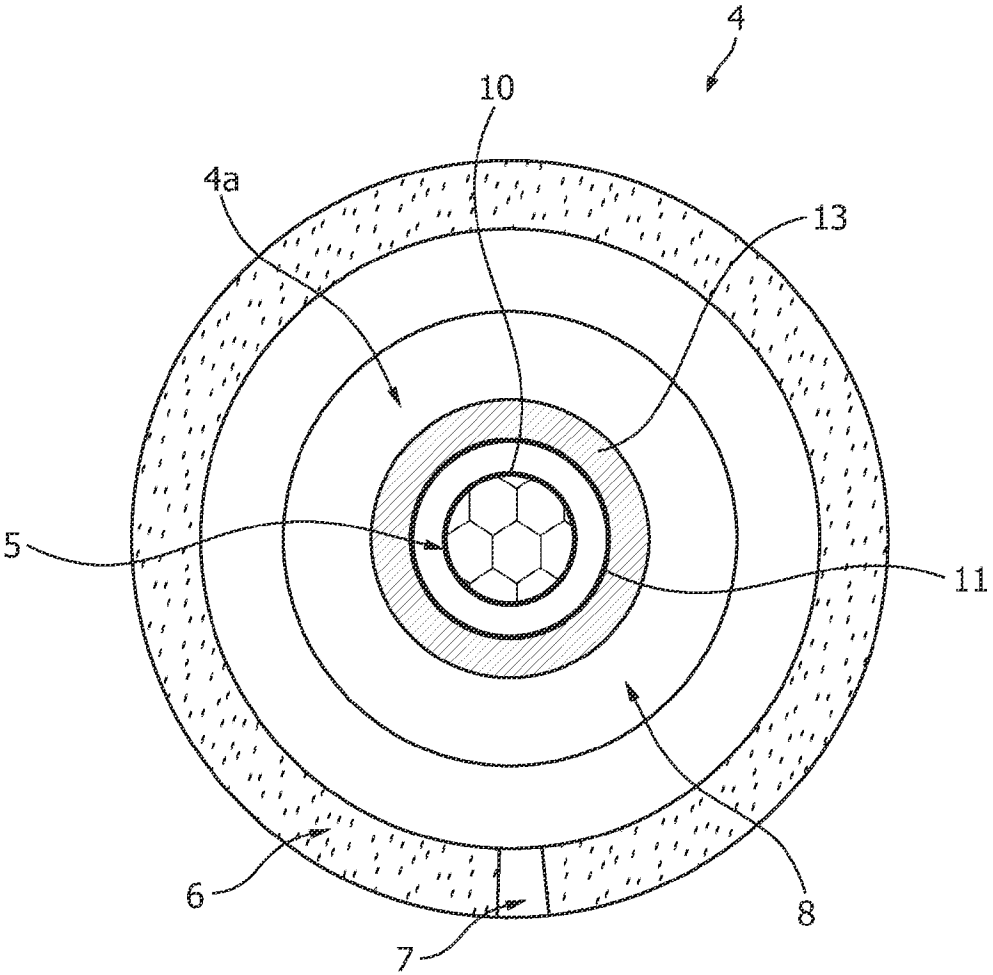
FIG. 2 shows a plan view of a rotating anode, in particular the anode disc according to an exemplary embodiment of the present invention.

Now referring to FIG. 2, a plan view of a rotating anode according to an exemplary embodiment of the present invention is depicted.

The anode disc 4*a* comprises an outer track 6, the focal spot track 6, with a focal spot 7. During operation, the focal spot track 6 and the focal spot 7 may be considered to be heated up, thus hot. An inner part of the rotating anode 8 may be considered to be substantially cooler than the focal spot track 6 and may be employed for heat dissipation to the hydrodynamic bearing 5, comprising a first bearing element 10 and a second bearing element 11.

The first bearing element 10 may be considered to be stationary whereas the second bearing element 11 may be considered to be rotating about the first bearing element 10, thus rotating the anode disc 4*a*.

The disc 4*a* of the rotatable anode 4 is attached to the second bearing element 11 by nut 13.

The exemplary direction of rotation is indicated by the circumferential arrow.

Figure 3:
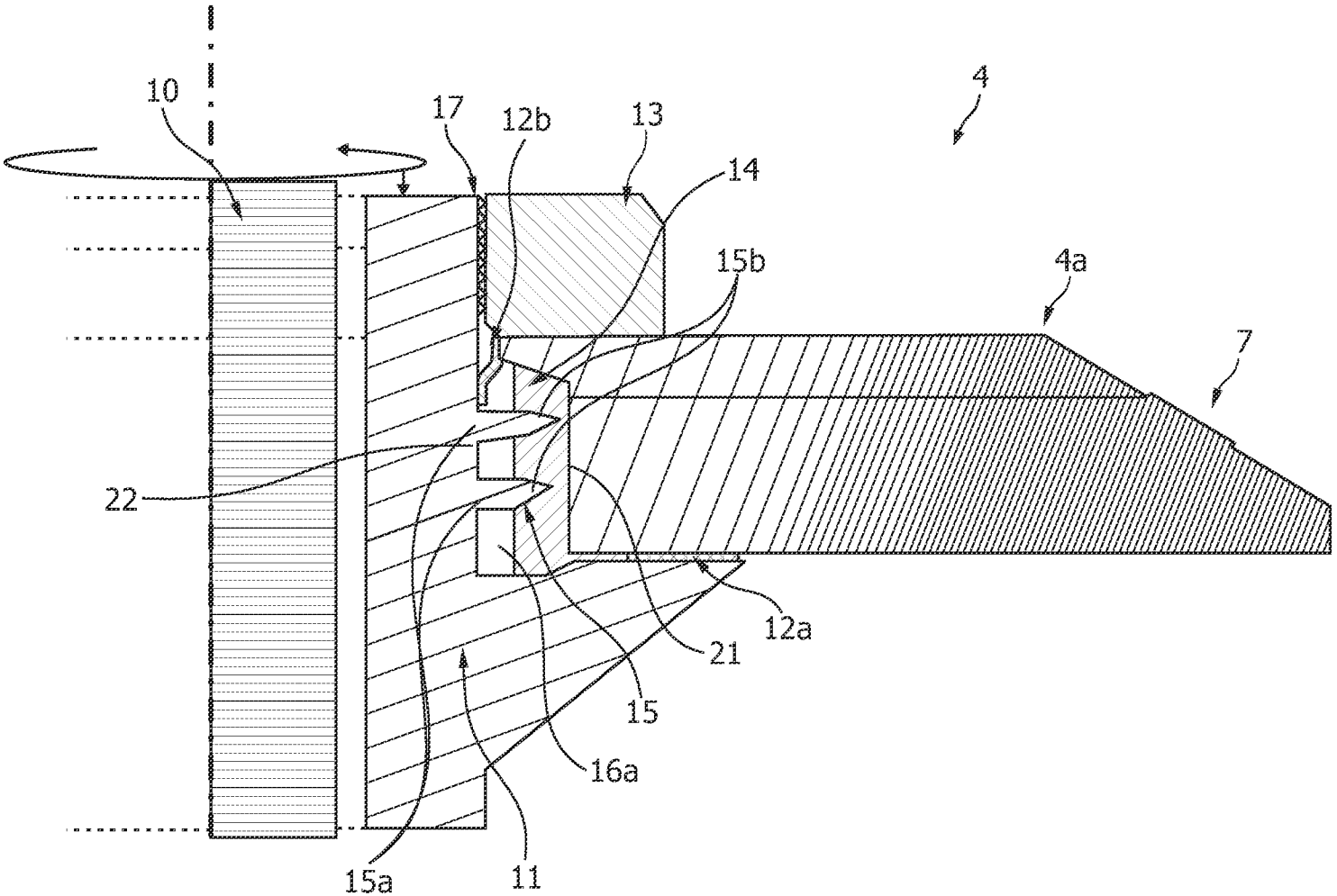
FIG. 3 shows a sectional view of a rotating anode in hot condition according to an exemplary embodiment of the present invention.

Now referring to FIG. 3, a sectional view of the rotating anode in hot operation mode according to an exemplary embodiment of the present invention is depicted.

The second bearing element 11 is rotating about the first bearing element 10.

The symmetrical construction is indicated by the symmetry line along the first bearing element 10.

The rotating anode disc 4*a* is attached to the second bearing element 11 by a compression force of nut 13. Nut 13 is substantially pressing the anode disc 4*a* onto a protruding part of the second bearing element 11.

A seal 12*a*, e.g. a graphite washer, is situated between the protruding part of the second bearing element 11 and a surface of the rotating anode disc 4*a*. The nut 13 may be seen as pressing down the anode disc onto the seal 12*a*. The nut 13 is attached to the second bearing element 11 by thread 17, which allows the nut to be screwed on/off the second bearing element 11, thus providing the pressure force required to affix the anode disc 4*a*.

An opening or gap 16 is formed between the disc 4*a* of the rotating anode 4 and the second bearing element 11. The opening 16 is partly filled with contact material 14, which is aligned at the side of the rotating anode disc 4*a* due to rotational forces, which occur in the depicted mode of operation of FIG. 3.

To provide a beneficial path for a heat transmission from the anode disc 4*a* to the second bearing element 11, contact elements 15 protrude radially from the second bearing element 11 into the contact material 14, thus allowing a heat transfer from anode disc 4*a* via the contact material 14 to the contact element 15 and subsequently to the second bearing element 11.

In the operational, hot state according to FIG. 3, the contact material 14 may be considered to be substantially liquid. A further seal 12*b*, a capillary force seal 12*b*, is employed for providing a tight, however dimensionally flexible seal. Seal 12*b* is in a decompressed state.

The temperature of the anode disc 4*a* is indicated by the grey colour progression, with the area of the focal spot 7 being substantially hotter that the parts closer to the bearing elements 10, 11.

The contact elements 15 comprise a first end 15*a* arranged at the surface of the second bearing element 22 and a second end 15*b* arranged at the inner side of the anode disc 21.

Figure 4:
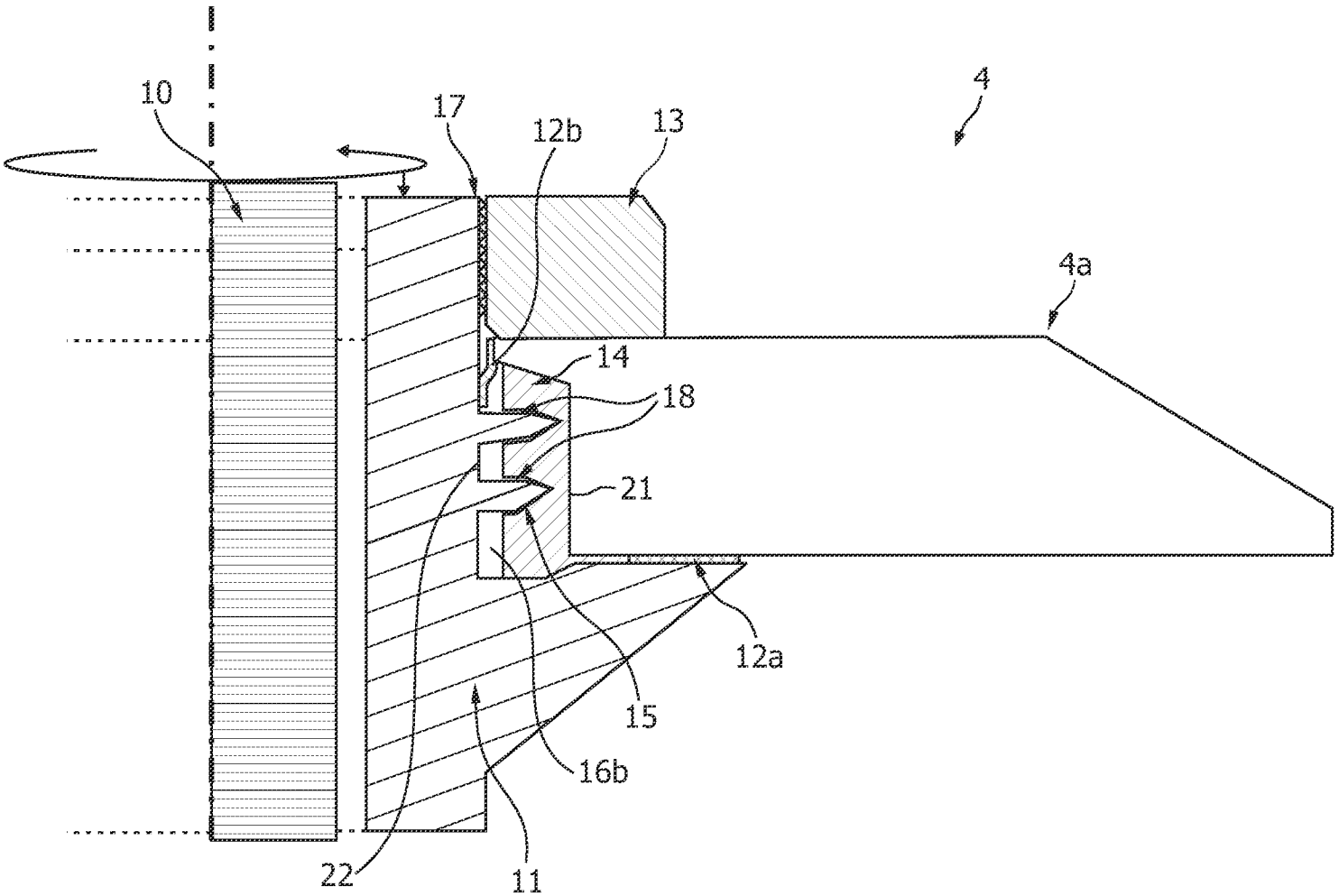
FIG. 4 shows a sectional view of a rotating anode in cooled down condition according to an exemplary embodiment of the present invention.

Now referring to FIG. 4, a sectional view of a rotatable anode in cooled down state according to an exemplary embodiment of the present invention is depicted.

The individual elements according to FIG. 4 are comparable to the respective elements of FIG. 3.

The disc 4*a* of the rotating anode 4 is cooled down, thus due to thermal contraction when cooling down, the gap 16 is reduced in size when compared to the gap 16 according to FIG. 3.

Due to the cooling down of the anode disc 4*a*, the inner side of the anode 21 is located nearer to the surface of the second bearing element 22, thus reducing the volume of the gap or opening 16*b*, as compared to FIG. 3.

Seal 12*b* still flexibly seals the opening 16*b*, however is more compressed than in FIG. 3. The contact material 14 may be considered to be non-liquid in FIG. 4, however may still be considered to be soft and flexible.

With the inner side of the anode 21 moving towards the surface of the second bearing element 22, while the contact material deliquifying, the contact elements 15 pierce or penetrate further into the soft, however solidified, contact material 14.

The sharp edges of the contact element 15 reach outward into the contact material 14 and provide a shear contact for heat conduction. The contact elements may be circular disc-like or individual protrusions. The contact material may be considered to "dodge" the edges of the contact elements upon anode shrinkage.

Due to the piercing effect of the contact elements, small shear gaps 18 may appear upon cooling and cutting of the contact material. However, the overall surface contact between contact elements 15 and contact material 14, thus the heat transfer may still be provided.

The seal 12*b* e.g. a spring steel ring is in a compressed state in FIG. 4.

It should be noted that the term "comprising" does not exclude other elements or steps and that "a" or "an" does not exclude a plurality. Also, elements described in association with different embodiments may be combined.

It should also be noted, that reference signs in the claims shall not be construed as limiting the scope of the claims.

LIST OF REFERENCE NUMERALS

1 X-ray system
2 X-ray tube
3 X-ray detector
4 Rotatable anode
4*a* Anode disc
5 Hydrodynamic bearing
6 Focal spot track
7 Focal spot
8 Inner part of rotatable anode
10 First bearing element
11 Second bearing element
12*a,b* Seal
13 Nut
14 Contact material
15 Contact element
15*a,b* First end, second end of contact element
16*a,b* Opening/gap
17 Thread
18 Shear gap
20 Cathode element
21 Inner side of anode
22 Surface of second bearing element
23 Object

The invention claimed is:

1. A rotatable anode (4) for generating X-rays, the anode (4) comprising
a bearing (10,11), the bearing (10,11) comprising
a first bearing element (10); and
a second bearing element (11);
wherein the second bearing element (11) is rotatable about the first bearing element (10);
an anode element (4*a*) arranged at the second bearing element (11);
an opening (16*a,b*), arranged between the second bearing element (11) and the anode element (4*a*);
wherein the opening (16*a,b*) is at least partly filled with a contact material (14);
at least one contact element (15) for providing a contact between the anode element (4*a*) and the second bearing element (11) and having a first end (15*a*) and a second end (15*b*);
wherein the first end (15*a*) is arranged at the second bearing element (11); and
wherein the second end (15*b*) is arranged to extend into the contact material (14).

2. The rotatable anode of claim 1, wherein
the anode element (4*a*) is attached to the second bearing element (11) such that a dimensional variation due to at least one of thermal expansion and a thermal reduction of the anode element (4*a*) is absorbable without destroying the contact between the anode element (4*a*) and the second bearing element (11).

3. The rotatable anode of claim 1, wherein
thermal energy is transmissible between at least two elements selected from the group consisting of anode element (4*a*), contact material (14), contact element (15) and second bearing element (11).

4. The rotatable anode of claim 1, wherein
the contact material (14) is one material selected from the group consisting of thermally conductive material, contact metal, liquid metal and indium tin alloy.

5. The rotatable anode of claim 1, wherein
the bearing (10,11) has a rotational axis; and wherein
the at least one contact element (15) is arranged radially extending from the rotational axis at the second bearing element (11).

6. The rotatable anode of claim 1, wherein
the second end (15*b*) of the contact element (15) is tapered for piercing the contact material (14).

7. The rotatable anode of claim 1, wherein
the second end (15*b*) of the contact element (15) is adapted as a sharp edged fin.

8. The rotatable anode of claim 1, wherein
the contact element (15) and the second bearing element (11) are integrally formed.

9. The rotatable anode of claim 1, wherein
the contact material (14) is sealed within the opening (16*a,b*) by at least one element selected from the group consisting of a seal (12*a,b*), a fixed seal, a
flexible seal, a flexible capillary force seal, a washer, a graphite washer, a spring ring, a spring metal ring and a spring steel ring.

10. An X-ray tube (2), comprising
a cathode element (20); and
a rotatable anode (4) according to claim 1;
wherein the cathode element (20) and the rotatable anode (4) are operatively coupled for the generation of X-rays.

11. An X-ray system (1) for examining of an object of interest, the X-ray system (1) comprising
an X-ray tube (2) according to claim 10; and
an X-ray detector (3);
wherein an object (23) is arrangeable between the X-ray tube (2) and the X-ray detector (3); and
wherein the X-ray tube (2) and the X-ray detector (3) are operatively coupled such that an X-ray image is obtainable of the object.

* * * * *